United States Patent [19]

Wittchow

[11] Patent Number: 4,926,799

[45] Date of Patent: May 22, 1990

[54] CONTINUOUS FLOW STEAM GENERATOR

[75] Inventor: Eberhard Wittchow, Erlangen, Fed. Rep. of Germany

[73] Assignee: Siemens Aktiengesellschaft, Munich, Fed. Rep. of Germany

[21] Appl. No.: 385,740

[22] Filed: Jul. 26, 1989

[30] Foreign Application Priority Data

Jul. 26, 1988 [EP] European Pat. Off. ..... 88112051.3
Jun. 26, 1989 [EP] European Pat. Off. ..... 89111630.3

[51] Int. Cl.[5] ..... F22B 15/00; F22B 25/00; F22B 37/10

[52] U.S. Cl. ..... 122/235 A; 122/6 A; 122/235 K; 122/406 S

[58] Field of Search ..... 122/235 A, 235 K, 235 D, 122/406 S, 406 ST, 6 A

[56] References Cited

U.S. PATENT DOCUMENTS 3,105,466 10/1963 Evans ..... 122/235 A
3,498,270 3/1970 Gorzegno et al. .
3,872,836 3/1975 Gorzegno et al. ..... 122/406 S
4,294,200 10/1981 Gorzegno ..... 122/406 S
4,524,727 6/1985 Ammann ..... 122/235 A
4,782,793 11/1988 Salem ..... 122/6 A

FOREIGN PATENT DOCUMENTS 1426702 10/1969 Fed. Rep. of Germany .
1167371 11/1958 France .
1163555 9/1969 United Kingdom .

*Primary Examiner*—Edward G. Favors
*Attorney, Agent, or Firm*—Herbert L. Lerner; Laurence A. Greenberg

[57] ABSTRACT

A continuous flow steam generator includes a vertical gas flue to which burners for fossil fuel are to be attached. The flue has a tube wall and a lower end with a bottom. The tube wall includes vertically disposed tubes with inlet and outlet ends and long sides being welded together in a gas-tight manner. The bottom includes other tubes having inlet and outlet ends and being welded together in a gas-tight manner. The tubes of the tube wall include tubes of a first tube group and tubes of a second tube group. The tubes of the first tube group are hydraulically connected to the other tubes of the bottom and have an outlet header connected to the tubes of the first tube group. The tubes of the second tube group have an inlet header and an outlet header connected to the tubes of the second tube group. A conduit is connected between the outlet header of the first tube group and the inlet header of the second tube group for hydraulically connecting the tubes of the second tube group downstream of the tubes of the first tube group. The inlet end of each tube of the first tube group merges with the outlet end of at least one of the other tubes of the bottom.

8 Claims, 2 Drawing Sheets

CONTINUOUS FLOW STEAM GENERATOR

The invention relates to a continuous flow or once-through steam generator having a vertical gas flue to which burners for fossil fuel are attached, the flue having a tube wall including vertically disposed tubes welded together in gas-tight fashion on the long sides thereof and a lower end with a bottom including tubes welded together in gas-tight fashion, the tube wall having tubes of first and second tube groups, the tubes of the bottom being connected hydraulically to the tubes of the first tube group having an outlet header, and the tubes of the second tube group having an inlet header and an outlet header and being hydraulically connected downstream of the tubes of the first tube group through a conduit connected between the outlet header of the first tube group and the inlet header of the second tube group.

A continuous flow steam generator of the above-described type is known from British Pat. No. 1,163,555. In that continuous flow steam generator, the tubes of the first tube group of the tube wall of the vertical gas flue have an inlet header, and the tubes of the bottom have an outlet header. Four approximately equidistant connecting tubes are provided. Each of the connecting tubes is connected at one end to one header and at the other end to the other header, so that each connects the two headers hydraulically. Both the bottom and the tube wall of the vertical gas flue of that continuous flow steam generator form evaporator heating surfaces.

It has been found that quite considerable thermal strains occur at the outlet ends of the vertically disposed tubes of the first group of the tube wall of such a continuous flow steam generator, if the generator is operated at a vapor pressure below the critical pressure, or in other words at partial load, for instance, and therefore at a low output of the feedwater pump.

It is accordingly an object of the invention to provide a continuous flow steam generator, which overcomes the hereinafore-mentioned disadvantages of the heretofore-known device of this generator type and which avoids such thermal strains.

With the foregoing and other objects in view there is provided, in accordance with the invention, a continuous flow steam generator, comprising a vertical gas flue having means for attaching burners for fossil fuel, a tube wall, and a lower end with a bottom, the tube wall including vertically disposed tubes with inlet and outlet ends and long sides being welded together in a gas-tight manner, the bottom including other tubes having inlet and outlet ends and being welded together in a gas-tight manner, the tubes of the tube wall including tubes of a first tube group and tubes of a second tube group, the tubes of the first tube group being hydraulically connected to the other tubes of the bottom and having an outlet header connected to the tubes of the first tube group, the tubes of the second tube group having an inlet header and an outlet header connected to the tubes of the second tube group, a conduit connected between the outlet header of the first tube group and the inlet header of the second tube group for hydraulically connecting the tubes of the second tube group downstream of the tubes of the first tube group, and the inlet end of each tube of the first tube group merging with the outlet end of at least one of the other tubes of the bottom.

Due to the absence of an outlet header for the tubes of the bottom and the absence of an inlet header for the tubes of the first group of the tube wall, the wet steam formed in the tubes of the bottom is prevented from unmixing upon passing into the tubes of the first group. Wet steam accordingly reaches the outlet ends of all of the tubes of the first group at a consistent temperature, so that even with vapor pressure below the critical pressure, no thermal strains arise.

In accordance with another feature of the invention, there is provided a distributor connected to the conduit, and a plurality of tubes leading from the distributor to the inlet header of the second tube group. In this way, unmixing, de-mixing or separating of the wet steam emerging from the first tube group on its way to the second tube group at a vapor pressure below the critical pressure is avoided, so that wet steam having approximately the same steam content enters all of the tubes of the second group. Once again, this evens out the temperature in the tubes of the second group at the outlet ends thereof and thus avoids thermal strains in the tube wall.

In accordance with a further feature of the invention, one of the tubes of the first tube group is hydraulically connected to at least two of the other tubes of the bottom. In this way, uniform cooling of the bottom of the vertical gas flue is attained.

In accordance with an added feature of the invention, the tubes of the first tube group have a different length than the tubes of the second tube group.

In accordance with an additional feature of the invention, the tubes of the second tube group form an upper end at a given height in the tube wall, the tube wall has vertically disposed branch tubes above the given height, and one of the tubes of the first tube group merges hydraulically with at least two of the branch tubes above the given height.

In accordance with yet another feature of the invention, the tubes of the second tube group form a lower end at a given height in the tube wall, the tube wall has vertically disposed individual tubes disposed above the given height, and at least two of the tubes of the first tube group merge hydraulically with one of the individual tubes below the given height.

In accordance with yet a further feature of the invention, the number of the tubes of the first tube group is different from the number of the tubes of the second tube group.

Therefore, the heat absorption of the tubes of the second group can be specified in an advantageous manner. As a result, a further evening out of the temperature of the outlet ends of the tubes of the second group can also be attained.

In accordance with a concomitant feature of the invention, at least one of the tubes of one of the tube groups is located between two of the tubes of the other of the tube groups in the tube wall. This feature additionally produces an evened-out temperature profile in the tube wall at the outlet ends of the tubes, in order to avoid thermal strains.

Other features which are considered as characteristic for the invention are set forth in the appended claims.

Although the invention is illustrated and described herein as embodied in a continuous flow steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
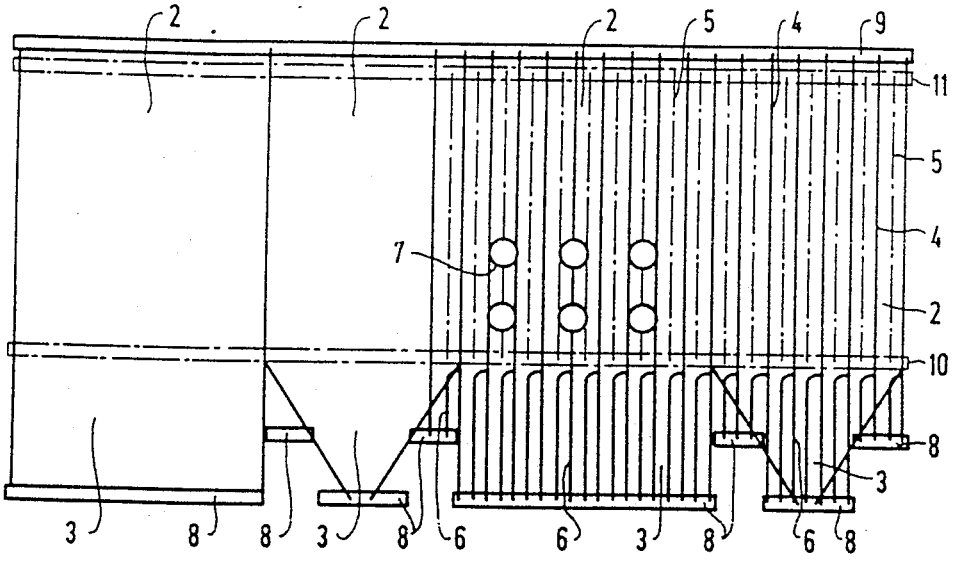
FIG. 1 is a highly diagrammatic, elevational view of developed projection of the vertical gas flue of a continuous flow steam generator according to the invention.

Referring now to the figures of the drawing in detail and first, particularly, to FIG. 1 thereof, there is seen a vertical gas flue having a rectangular cross section, a tube wall 2 and a funnel-shaped bottom 3. The tube wall 2 has tubes 4 and 5, all of which are vertically disposed and are welded together in gas-tight fashion on the long sides thereof. The bottom 3 is constructed of tubes 6 that are likewise welded together in gas-tight fashion on the long sides thereof. The tubes 6 are straight, but they may also be coiled. The bottom 3 may also be flat and horizontal, or may slope slightly.

Six burners for fossil fuel are attached to the lower part of the tube wall 2 of the vertical gas flue, each being disposed in a respective opening 7 in the tube wall 2. The tubes 4 and/or 5 of the tube wall 2 are curved at such an opening and extend on the outside of the vertical gas flue. Similar openings may also be formed for air nozzles, flue gas nozzles, soot blowers, observation ports, and so forth.

The tubes 6 of the funnel-like bottom 3 have inlet ends connected to inlet headers or manifolds 8. The vertically disposed tubes 4 of the tube wall 2 form a first tube group. Each tube 4 of this first group has an inlet end which communicates hydraulically with outlet ends of two tubes 6 of the bottom 3. The tubes 4 of the first group have outlet ends which discharge in an outlet header 9. Thus the outlet ends of two tubes 6 merge with the inlet end of each tube 4. Each tube 5 of a second tube group is located between two tubes 4 of the first tube group, to which it is welded in gas-tight fashion on the long sides thereof. Likewise, each tube 4 of the first group is located between two tubes 5 of the second group, to which it is also welded in gas-tight fashion on the long sides thereof.

Additionally, all of the tubes 5 of the second group have inlet ends connected to a further inlet header 10 and outlet ends connected to a further outlet header 11.

Figure 2:
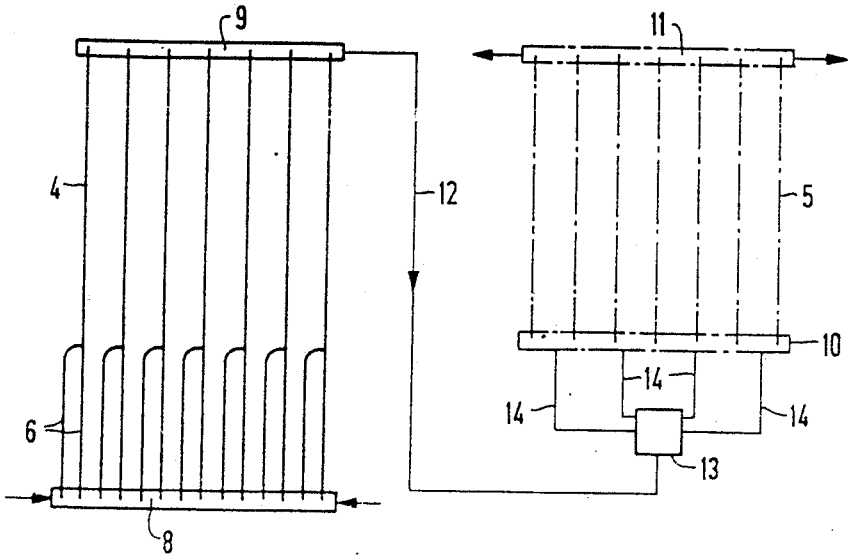
FIG. 2 is a flow diagram for the vertical gas flue of FIG. 1.

As FIG. 2 shows, the outlet header 9 of the tubes 4 of the tube wall 2 in the first group communicates hydraulically by means of a conduit 12 with the inlet header 10 of the tubes 5 of the second group, without the tubes of the bottom 3 intervening. The conduit 12 is located on the outside of the vertical gas flue and includes a distributor 13. Four tubes 14 lead from the distributor 13 to the inlet header 10.

Water flows from the inlet headers 8 into the tubes 6 of the bottom 3 and from there into the tubes 4 of the tube wall 2 and is evaporated. Wet steam reaches the outlet header 9. This wet steam flows through the conduit 12 into the distributor 13 and is distributed uniformly, in other words with the same steam content, to the four tubes 14. From the tubes 14, the wet steam reaches the inlet header 10 and enters the tubes 5 of the second group of the tube wall 2.

The wet steam is not heated on its way from the outlet header 9 to the inlet header 10, and therefore it has the same steam content as it enters all of the tubes 5 of the second group. In these tubes 5, heat is supplied to this steam uniformly, so that consistently only wet steam, saturated steam or superheated steam is located at the outlet ends of all of the tubes 5 and is fed into the outlet header 11. Thermal strains in the tube wall 2 when the vapor pressure is below the critical pressure are therefore precluded even if the tubes 6 of the bottom 2 are of different lengths and absorb different amounts of heat.

Figure 3:
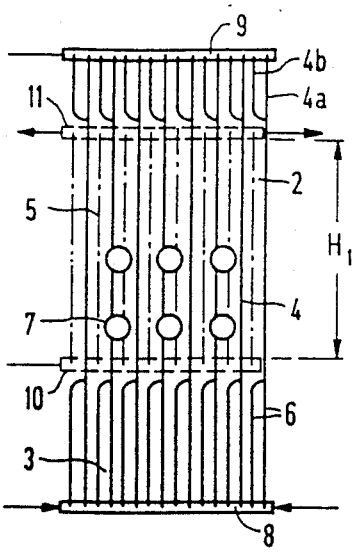
FIGS. 3–5 are elevational views showing modified details of the developed projection of the vertical gas flue of FIG. 1.

In FIG. 3, the tubes 5 of the second group in the tube wall 2 form an upper end at a given height $H_1$, where they emerge from the tube wall 2 to the outside of the vertical gas flue. Above this height $H_1$, each tube 4 of the first group merges hydraulically with two vertically disposed branch tubes 4a and 4b of the tube wall 2, which belong to the first tube group and have outlet ends connected to the outlet header 9. As a result, only a comparatively small quantity of heat is transferred to the tubes 5 of the second tube group, and the temperature at the outlet ends of the tubes 5 that discharge into the outlet header 11 is made more uniform, in order to prevent thermal strains.

Figure 4:
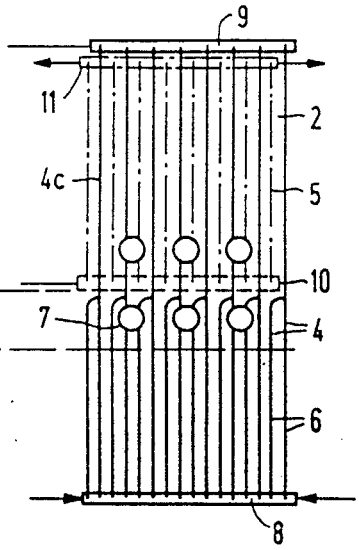

In FIG. 4, the tubes 5 of the second group of the vertical gas flue form a lower end at a given height $H_2$, where they enter the tube wall 2 from the outside of the vertical gas flue. Below this height $H_2$, each two tubes 4 of the first group merge hydraulically with a vertically disposed individual tube 4c of the tube wall 2, which likewise belongs to the first tube group and is located above the height $H_2$. The resultant effect is like that attained with the embodiment of FIG. 3.

Figure 5:
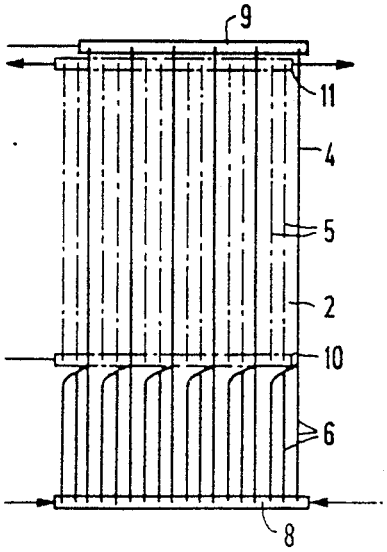

In FIG. 5, the inlet end of each tube 4 of the first group communicates hydraulically with the outlet ends of three tubes 6 of the bottom 3. Moreover, each two tubes 5 of the second group of the tube wall 2, which are welded to one another in gas-tight fashion on the long sides thereof, are disposed between two tubes 4 of the first group and are welded on the long sides thereof to the long sides of these tubes 4 in a gas-tight manner. The number of tubes 5 of the second group connected to the headers 10 and 11 is thus twice as great as the number of tubes 4 of the first group connected to the tubes 6 and to the outlet header 9. Once again, an effect as with the embodiment of FIG. 3 is attained.

Through the use of a conduit, the outlet header for the tubes of the second group of the tube wall may communicate hydraulically with other tubes of the tube wall of the vertical gas flue not belonging to the first or second group, or with inlet headers of superheater heating surface of the continuous flow steam generator.

The tubes of the tube wall and the bottom of the vertical gas flue may have helical internal ribs, so that the water contained in the wet steam flowing through these tubes collects predominantly on the inside of the tubes. This brings about a relatively low and uniform temperature of the tubes and likewise prevents thermal strains in the tube wall and in the bottom.

Flue gas leaving the vertical gas flue may also be returned to the vertical gas flue in the form of a flue gas circulation, for instance through flue gas nozzles, after cooling at heating surfaces of the continuous flow steam generator.

The foregoing is a description corresponding in substance to European Application No. 89 111 630.3, dated June 26, 1989, the International priority of that application and of European Application No. 88 112 051.3, dated July 26, 1988 being claimed for the instant application, and being hereby made part of this application. Any material discrepancies between the foregoing specification and the first aforementioned corresponding European application are to be resolved in favor of the latter.

I claim:

1. Continuous flow steam generator, comprising a vertical gas flue having means for attaching burners for fossil fuel, a tube wall, and a lower end with a bottom, said tube wall including vertically disposed tubes with inlet and outlet ends and long sides being welded together in a gas-tight manner, said bottom including other tubes having inlet and outlet ends and being welded together in a gas-tight manner, said tubes of said tube wall including tubes of a first tube group and tubes of a second tube group, said tubes of said first tube group being hydraulically connected to said other tubes of said bottom and having an outlet header connected to said tubes of said first tube group, said tubes of said second tube group having an inlet header and an outlet header connected to said tubes of said second tube group, a conduit connected between said outlet header of said first tube group and said inlet header of said second tube group for hydraulically connecting said tubes of said second tube group downstream of said tubes of said first tube group, and said inlet end of each tube of said first tube group merging with said outlet end of at least one of said other tubes of said bottom.

2. Continuous flow steam generator according to claim 1, including a distributor connected to said conduit, and a plurality of tubes leading from said distributor to said inlet header of said second tube group.

3. Continuous flow steam generator according to claim 1, wherein one of said tubes of said first tube group is hydraulically connected to at least two of said other tubes of said bottom.

4. Continuous flow steam generator according to claim 1, wherein said tubes of said first tube group have a different length than said tubes of said second tube group.

5. Continuous flow steam generator according to claim 4, wherein said tubes of said second tube group form an upper end at a given height in said tube wall, said tube wall has vertically disposed branch tubes above said given height, and one of said tubes of said first tube group merges hydraulically with at least two of said branch tubes above said given height.

6. Continuous flow steam generator according to claim 4, wherein said tubes of said second tube group form a lower end at a given height in said tube wall, said tube wall has vertically disposed individual tubes disposed above said given height, and at least two of said tubes of said first tube group merge hydraulically with one of said individual tubes below said given height.

7. Continuous flow steam generator according to claim 1, wherein the number of said tubes of said first tube group is different from the number of said tubes of said second tube group.

8. Continuous flow steam generator according to claim 1, wherein at least one of said tubes of one of said tube groups is located between two of said tubes of the other of said tube groups in said tube wall.

* * * * *